US005216758A

United States Patent [19]

Rabquer

[11] Patent Number: 5,216,758

[45] Date of Patent: Jun. 8, 1993

[54] SPORTS FACE MASK ATTACHMENT

[76] Inventor: William A. Rabquer, 3514 Torrance Dr., Toledo, Ohio 43612

[21] Appl. No.: 790,534

[22] Filed: Nov. 12, 1991

[51] Int. Cl.[5] ..... A42B 1/08

[52] U.S. Cl. ..... 2/424; 2/9

[58] Field of Search ..... 2/9, 173, 206, 424, 2/425, 2, 206, 410

[56] References Cited

U.S. PATENT DOCUMENTS 4,736,466 4/1988 Kallstrom ..... 2/9

4,999,856 3/1991 DuVall ..... 2/424

*Primary Examiner*—Werner H. Schroeder

*Assistant Examiner*—Diana L. Biefeld

[57] ABSTRACT

A sports helmet face mask attachment which reduces intentional or unintentional face mask grabbing and thus reduces head or neck injuries. A light weight, perforated strip of flexible material is stretched across wire members of the face mask, closing off the openings between wire members of the lower portion of the face mask, leaving uncovered the opening or openings at eye level. Closing off the openings located on the lower portion of the face mask make it impossible for an opponent to grab that portion of the mask and cause injury by violent pulling or twisting. The attachment can be secured to the wire members of the face mask by snaps, ties, or other means.

2 Claims, 1 Drawing Sheet

SPORTS FACE MASK ATTACHMENT

FIELD OF THE INVENTION

The present invention relates to protective sports equipment. More specifically, the invention relates to an attachment to a sports helmet face mask.

BACKGROUND OF THE INVENTION

The field of the invention relates to sports helmets and face masks which are required equipment for participation in a high contact sport such as football. During the regular course of a game, a helmet and the attached face mask are subjected to numerous forces from a variety of angles. The face mask itself serves to protect a player from facial injuries due to frontal or oblique impact as well as protects from being poked or gouged by an opponent's fingers during play.

A conventional face mask is usually made of a wire frame mounted to a football helmet with substantial gaps between wire members to allow ventilation and virtually unrestricted vision. A problem arises when an opponent grabs the wire face mask and violently pulls it down or twists it, creating a possibility of a serious or even life-threatening neck injury to the wearer. The risk is so great that special rules are in force to discourage players from grabbing the face mask. While the penalty for the rule violation will act as a deterrent, there are also many instances of unintentional face mask grabbing or holding which are not reduced by a penalty system.

OBJECTS OF THE INVENTION

It is therefore an object of this invention to provide an inexpensive addition to conventional wire face masks which can be attached thereto over a portion of the openings between the wire and which will physically prevent that portion of the mask from being intentionally or unintentionally grasped by a game participant.

It is another object of this invention to provide an attachment for conventional face masks which can be attached and removed as desired for cleaning or maintenance purposes and which is inexpensive and may be readily adjusted to different masks.

It is still another object of this invention to provide a face mask attachment which, while preventing intentional and unintentional grasping, does permit air to pass through and does permit the wearer to have some vision through the attachment as will be explained below.

Other advantages of the present invention will be understood from the following detailed description of the preferred embodiment, with reference being made to the drawings.

DESCRIPTION OF THE PREFERRED EMBODIMENTS

Figure 1:
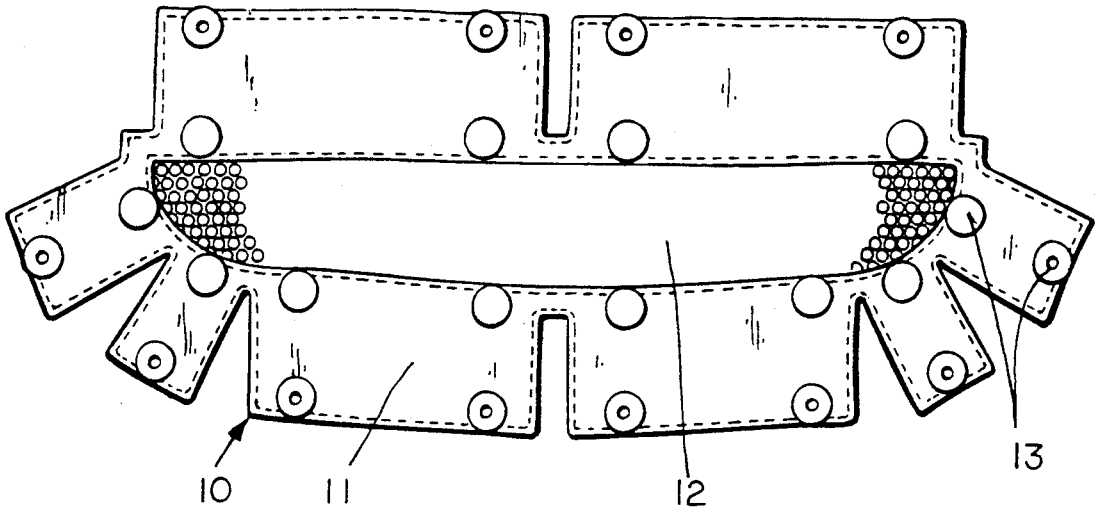
FIG. 1 is a front plan view of the invention.

FIG. 1 shows a front plan view of a face mask attachment 10 in the unfolded position. The present invention is a generally flat strip of flexible material shaped to facilitate attachment on a wire face mask. Edging material 11 surrounds the perforated ventilated material 12 and forms an outer border, holding the ventilated material 12 in place. The ventilated material 12 forms the inner portion of the attachment and is perforated to allow flow-through ventilation and at least limited visibility. The edging material 11 and ventilated material 12 combination is stretched across the lower openings defined by wire members of a face mask and secured by preferably, though not necessarily, snaps 13.

Figure 2:
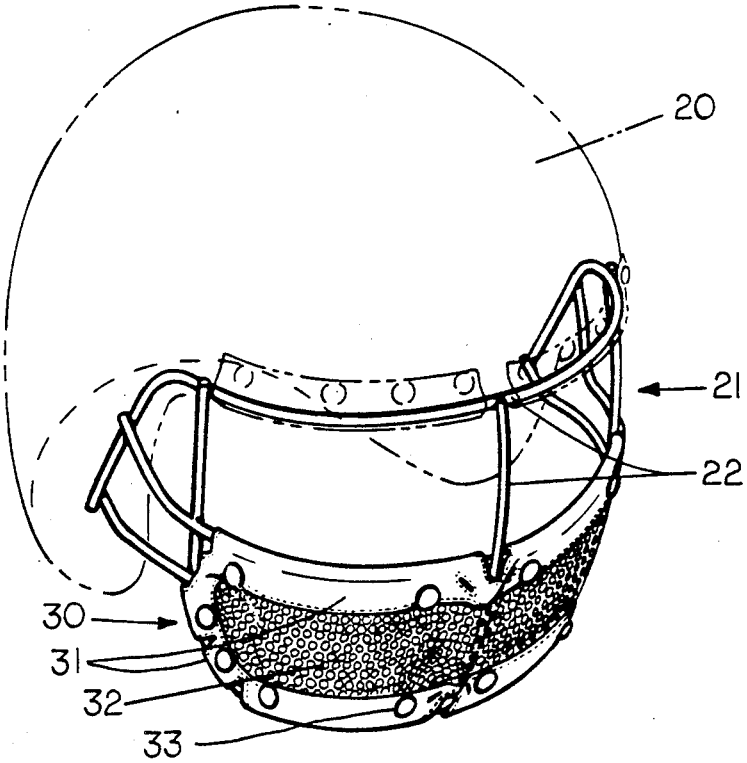
FIG. 2 is a perspective view of a football helmet body, wire face mask, and the invention as attached to the wire face mask.

FIG. 2 is front perspective view of a football helmet 20, wire face mask 21 and the present invention 30 secured to the face mask 21. The attachment 30 is fastened to wire members 22 of the face mask 21 by preferably, though not necessarily, snaps 33 sewn into the edging material 31. The ventilated material 32 closes off the lower openings of the face mask 21 while still allowing substantial air flow and limited peripheral vision in a downward or lateral direction.

As thus far described, it will be seen that the attachment for a face mask of this invention can be used with conventional wire helmet face guards and will be effective to (1) prevent intentional or unintentional grasping of the portion of the wire mask which the attachment covers and (2) will be also effective to keep unintended fingers or toes or other objects out of the interior of the wire mask, thus adding additional protection to the teeth and lips of the wearer. The attachment has the advantage that, being of flexible material, it may be detached as by the snaps 13 and washed or otherwise treated between wearings.

As also stated above, the mask is perforated to the extent that it allows free air flow through the mask and also allows limited vision so that the wearer may look downwardly towards the ground and perceive objects which otherwise would be completely unseen by the wearer if the mask were not perforated.

Those skilled in the art may envision alternate ways of attachment of the mask and alternate geometric shapes for attaching to different types of wire face guards. While certain attachment devices such as Velcro or adhesive straps may be used, it is believed that a snap system of the type shown is preferred, in that the snaps will stay fastened and undertake a heavy sheer as would be encountered by the mask, and yet be readily removable when intentionally unsnapped in a direction along the axis of the snap.

Other objects and advantages of the heretofore described invention will be apparent to those skilled in the art and may be incorporated without departing from the scope and spirit of the attached claims.

What is claimed is:

1. An improved sports helmet comprising: a rigid helmet body, said helmet body generally shaped to fit about a wearer's head and having a a face mask, said face mask secured to said helmet body and extending downward over the face of the wearer and including an open grid of rigid elongate wires having large openings therebetween; and a face mask attachment, said attachment affixed to said grid of wires over said large openings to prevent pulling or twisting of said face mask, said attachment comprising an elongate flat strip of flexible material of generally uniform thickness and a non-curved rear surface, said attachment having a perforated inner portion through which air may circulate but which is effective to prevent fingers from extending therethrough, and a non-perforated outer edge portion surrounding said perforated inner portion, said outer edge portion incorporating detachable fasteners to affix said face mask attachment to the area external to said grid of wires, whereby an external hand may not enter said mask grid or pull or twist upon the same.

2. The sports helmet and mask of claim 1 wherein said outer imperforate portion is adapted to fold around a wire of said grid and attach itself by said detachable fasteners to an adjacent portion folded opposite to said folded portion.

* * * * *